US008003177B2

(12) United States Patent
Mahoney

(10) Patent No.: US 8,003,177 B2
(45) Date of Patent: Aug. 23, 2011

(54) DUCTILE PRINTED MEDIA AND METHODS OF USE THEREFORE

(76) Inventor: Travis Mahoney, Cypress, CA (US)

( * ) Notice: Subject to any disclaimer, the term of this patent is extended or adjusted under 35 U.S.C. 154(b) by 895 days.

(21) Appl. No.: 11/850,001

(22) Filed: Sep. 4, 2007

(65) Prior Publication Data

US 2009/0061123 A1 Mar. 5, 2009

(51) Int. Cl.
*B41M 5/40* (2006.01)

(52) U.S. Cl. ..... 428/32.16; 428/32.18; 428/209; 428/413; 428/446; 428/457; 140/3 R

(58) Field of Classification Search ..... 428/32.16, 428/32.18, 209, 413, 446, 457; 140/3 R
See application file for complete search history.

(56) References Cited

U.S. PATENT DOCUMENTS

| | | | | |
|---|---|---|---|---|
| 615,025 | A | 11/1898 | Hulbert | |
| 2,642,030 | A | 6/1953 | Brink | |
| 4,297,154 | A | 10/1981 | Keller | |
| 4,648,188 | A | 3/1987 | Blair | |
| 4,929,213 | A | 5/1990 | Morgan | |
| 5,040,005 | A | 8/1991 | Davidson et al. | |
| 5,345,705 | A | 9/1994 | Lawrence | |
| 5,380,391 | A | 1/1995 | Mahn, Jr. | |
| 5,855,980 | A | 1/1999 | Roualdes et al. | |
| 6,023,872 | A | 2/2000 | Falkenstein, Sr. | |
| 6,040,014 | A | 3/2000 | Izmirlian et al. | |
| 6,066,391 | A | 5/2000 | Ogawa et al. | |
| 6,096,668 | A | 8/2000 | Abuto et al. | |
| 6,325,501 | B2 | 12/2001 | Kuwabara et al. | |
| 6,444,147 | B1 | 9/2002 | Harding | |
| 6,458,140 | B2 * | 10/2002 | Akin et al. | 606/153 |
| 6,589,636 | B2 * | 7/2003 | Emslander et al. | 428/195.1 |
| 6,651,370 | B1 | 11/2003 | Sud | |
| 6,656,551 | B1 | 12/2003 | Dyl | |
| 6,723,668 | B2 | 4/2004 | Principe | |
| 6,916,436 | B2 | 7/2005 | Tarabula | |
| 2002/0068493 | A1 | 6/2002 | Roettger et al. | |
| 2004/0137249 | A1 * | 7/2004 | Kamiyama | 428/483 |
| 2005/0150591 | A1 | 7/2005 | Goertzen | |
| 2006/0283344 | A1 | 12/2006 | Ferguson | |

* cited by examiner

*Primary Examiner* — Betelhem Shewareged
(74) *Attorney, Agent, or Firm* — QuickPatents, Inc.; Kevin Prince

(57) ABSTRACT

A ductile media for receiving an image thereon is disclosed and comprises a ductile mesh and an elastomeric membrane fixed to at least a top side of the mesh. The ductile mesh is preferably an expanded metal material. The elastomeric membrane has a substantially flat top surface that is adapted to receive the image thereon. A printable coating may be further applied to the top surface of the membrane. In one embodiment of the invention, a selectively removable liner is temporarily fixed with adhesive to a bottom surface of the mesh or to a bottom surface of the elastomeric membrane to prevent printer feeding rollers of a printing device, for example, from deforming or stretching the media as the media advances through the printing process. Alternately the image may be applied to the ductile media through a heat transfer or dye-sublimation process. Once the image is printed on the media, the user may form the media into a desired shape by applying pressure thereto. Additionally, the elastomeric membrane may be impregnated with a water-reactive hardening agent, such that once the media is formed into a desired shape, water may be introduced to the elastomeric membrane to activate the hardening agent and cause the media to become substantially rigid.

21 Claims, 3 Drawing Sheets

DUCTILE PRINTED MEDIA AND METHODS OF USE THEREFORE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to printable media, and more particularly to a ductile printable media.

DISCUSSION OF RELATED ART

The applications for printing images on various types of media are virtually endless. From advertising to artwork, the printed color image on flat media has existed since the printing press, and continues to be an important segment of the economy. As such, those in the creative printing and advertising businesses, artists, and others who are responsible for putting ink on paper, frequently look for means by which to differentiate their products from others.

For example, printing onto a media that can be converted from a two-dimensional media into a three-dimensional media is one such way of differentiating a printed document or artwork. A three-dimensional image catches a person's eye as he moves with respect to the image, causing the person to focus more on such an image. Clearly such three-dimensional images are useful to advertisers, artists, and others competing for a person's attention in what may be a visually-busy environment.

Several prior art devices and methods exist for printing onto a two-dimensional surface and then shaping the resulting media into a three-dimensional form. For example, US Patent Application 2006/0283344 to Ferguson on Dec. 21, 2006, teaches a method of printing a two-dimensional image onto a sheet that is then vacuum formed onto a three-dimensional mold. U.S. Pat. No. 6,916,436 to Tarabula on Jul. 12, 2005 teaches a similar method, as does U.S. Pat. No. 6,023,872 to Falkenstein, Sr. on Feb. 15, 2000; and U.S. Pat. No. 5,040,005 to Davidson et al. on Aug. 13, 1991.

Such prior art methods typically require a pre-made form onto which the two-dimensional image is applied. Without the form such prior art methods fail to produce a three-dimensional image.

U.S. Pat. No. 615,025 to Hulbert on Nov. 29, 1898, teaches a device and method for producing a relief photograph. A malleable, non-elastic layer is fixed behind a picture, and both are mounted in a rigid frame. The malleable layer, such as a lead sheet, is then formed by hand, and the result is the picture is embossed. However, such a system cannot produce significant vertical axis shifts in a photographic image without tearing the photograph. No mention is made of producing a photo onto a flexible surface, such as a fabric, since once the malleable layer is removed the fabric would revert back to its original shape. U.S. Pat. No. 6,651,370 to Sud on Nov. 25, 2003, teaches a related device.

Other prior art three-dimensional imaging methods and devices are taught in the following US Patents or US Patent Applications:

| Publication No. | Date | Inventor(s) |
|---|---|---|
| 2005/0150591 | Jul. 14, 2005 | Goertzen |
| 4,929,213 | May 29, 1990 | Morgan |
| 4,648,188 | Mar. 10, 1987 | Blair |
| 5,345,705 | Sep. 13, 1994 | Lawrence |
| 6,444,147 | Sep. 3, 2002 | Harding |

Malleable materials are not limited to lead sheets in the prior art. Expanded metal mesh having a paper or laminate backing, for example, are disclosed in U.S. Pat. No. 4,297,154 to Keller on Oct. 27, 1981; U.S. Pat. No. 3,308,591 to Goldsworthy on Mar. 14, 1967; and U.S. Pat. No. 2,642,030 to Brink on Jun. 16, 1953. Such materials, however, are not suitable for forming a three-dimensional image thereon since paper is non-elastic and does not easily bend with the metal mesh thereunder. Further, US Patent Application 2002/0068493 to Roettger et al. on Jun. 6, 2002, teaches a ductile material web having a backing material for use in roofing applications. Such a device is not suitable for receiving a printed image thereon.

There are printing methods for printing an image onto an elastic material, such as non-woven foam rubber materials, textile fabrics, and the like. For example, such methods and articles of manufacture are found in the following US Patents:

| Publication No. | Date | Inventor(s) |
|---|---|---|
| 5,380,391 | Jan. 10, 1995 | Mahn, Jr. |
| 6,040,014 | Mar. 21, 2000 | Izmirlian et al. |
| 6,096,668 | Aug. 1, 2000 | Abuto et al. |
| 6,325,501 | Dec. 4, 2001 | Kuwabara et al. |
| 6,656,551 | Dec. 2, 2003 | Dyl |

Such prior art device, and particularly dye sublimation processes, are well-suited to transferring an image onto a fabric or other elastomeric web. Such images may be durable, washable, and easily stretched and formed. However, without a ductile layer fixed to such a flexible or elastomeric web, any three-dimensional shape formed therein is unable to be maintained. It is not readily apparent how to provide such ductile properties to fabric or elastomeric webs of this type, and no suggestion of such is provided in the prior art.

U.S. Pat. No. 6,066,391 to Ogawa et al. on May 23, 2000 teaches a three-dimensional cloth molding that is formed into a three-dimensional shape while a foam layer is still in a viscoelastic fluid state. Upon curing the three-dimensional shape is maintained. However, such a device is ill-suited for receiving a printed image after the foam layer has cured.

Therefore, there is a need for a ductile media that can receive a printed image thereon and be shaped and formed manually or by using conventional embossing tools into a three-dimensional image, all without tearing, creasing, or bunching thereof. Such a needed media would allow shaping thereof without the use of special tooling, molding equipment or thermoforming machinery, or continuous pressure applied thereto. Further, the shaping of such a needed device would be reversible, if desired, multiple times without damaging the media. Moreover, such a needed device would be capable of being easily hardened into a permanent, rigid shape if desired, and combined with other media or objects to form a sculpture or other solid construct. Further, a variety of transfer sheets and heat transfer devices and processes could be used with such a needed media. The present invention accomplishes these objectives.

SUMMARY OF THE INVENTION

The present device is a ductile media for receiving an image thereon. The image may be applied using any suitable means, such as an ink-jet printer, a silkscreen process, a heat transfer process, paintbrush, airbrush, spray, paint, or the like. The media comprises a ductile mesh and an elastomeric membrane fixed to at least a top side of the mesh. The ductile mesh is preferably an expanded metal material, such as expanded metal mesh, or shape memory alloy or knit wire mesh that is able to conform to irregular surfaces without breaking, creasing, or tearing while still being able to maintain whatever shape it is formed into. The elastomeric membrane has a substantially flat top surface that is adapted to receive the image thereon. A printable coating may be further applied to the top surface of the membrane. The printable coating may be a type of composition for treating both natural and synthetic fabrics typically used in conjunction with printing on fabrics with the use of inkjet printers, thermal, piexo, picot, or laser printers, copiers, or the like In one embodiment of the invention, a selectively removable liner is temporarily fixed with adhesive to at least one surface of the mesh or to a bottom surface of the elastomeric membrane. Such an inelastic liner prevents printer feeding rollers of a printing device, or the like, from deforming or stretching the media as the media advances through the printing process.

In use, an image may be printed onto the ductile media by a) providing the media and b) instructing a user to print the image onto the ductile media with the printing device, such as an inkjet printer, silkscreen apparatus, or the like. The media is thin enough to pass through such a printing device.

Alternately the image may be applied to the ductile media by instructing a user to print the mirror image of the image onto a transfer sheet, which is then applied to the top surface of the elastomeric membrane and heated to affect a heat transfer of the image onto the media. Or the image may be applied to the ductile media by a screen printing process, the top surface of the elastomeric membrane adapted to receive screen printing ink.

Once the image is printed on the media, the user may form the media into a desired shape by applying pressure to the media. Various tools (not shown) may be used to aid in forming relief detail into the media. Additionally, a hardening agent may be used, once the media is formed into a desired shape, to cause the media to become substantially rigid.

The present invention is a ductile media that can receive a printed image thereon and be shaped and formed manually or by using conventional embossing tools into a three-dimensional image. The present media may be shaped repeatedly without tearing, creasing, or bunching thereof. The present invention may be shaped without the use of special tooling, molding equipment or thermoforming machinery, and will maintain its shape without continuous pressure being applied thereto. Further, the shaping of the present device is reversible multiple times without causing damage thereto. Moreover, the media may be easily hardened into a permanent, rigid shape if desired, and combined with other media or objects to form a sculpture or other solid construct. Further, a variety of transfer sheets and heat transfer devices and processes may be used with the present invention.

The present invention, in use, begins as a flat sheet that receives the image, and which can then be formed into three-dimensional relief images which more readily grab the attention of viewers. The process of manually forming the three-dimensional images is, itself, relaxing, satisfying, and a source of pride once the three-dimensional image is fully formed. Such three-dimensional images make excellent point-of-purchase displays, free-standing signs, hanging banners, indoor and outdoor billboards, wall-mounted signs, exhibit displays, and the like. Further, the present invention has application in the creation of large scale sculptures, mold making, furniture design, exhibit design, handbag and other apparel prototype making, fine art displays, scrapbooking, three-dimensional pattern and sculpture making, and art canvases. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
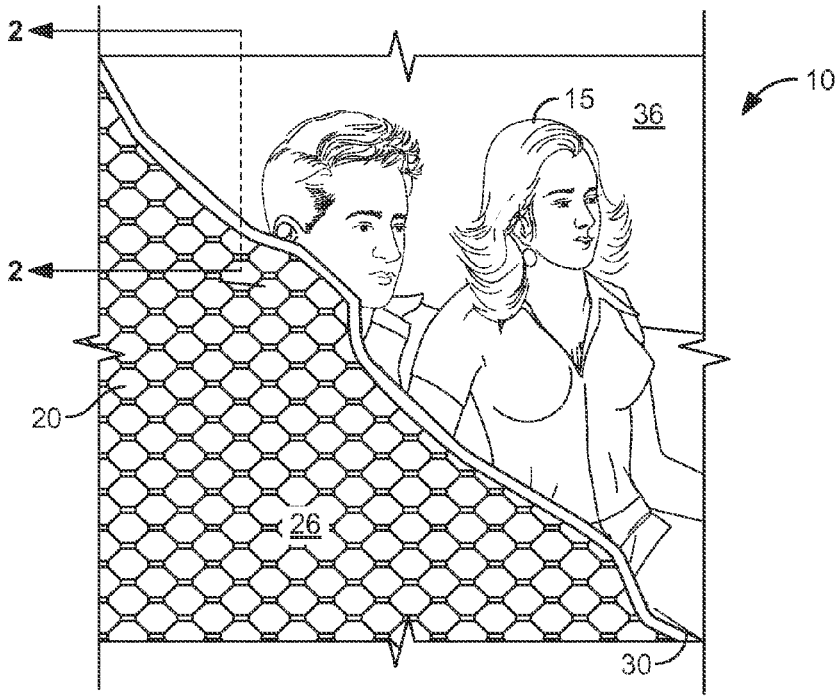
FIG. 1 is a top plan view, partially cut-away, illustrating a ductile mesh fixed to an elastomeric membrane.

FIG. 1 shows a ductile media 10 for receiving an image 15 thereon. The image 15 may be applied using any suitable means, such as an ink-jet printer, a silkscreen process, a heat transfer process, paintbrush, airbrush, spray paint, or the like. The preferred method is by utilizing a heat transfer process such as ink sublimation.

The media 10 comprises, in the simplest embodiment, a ductile mesh 20 and an elastomeric membrane 30 fixed to at least a top side 26 of the mesh 20 (FIG. 1). The ductile mesh 20 is preferably an expanded metal material, such as expanded metal mesh Material # 15AI 17-380 A from Dexmet Corporation, Naugatuck, Conn. 06770, for example. The ductile mesh 20 may alternately be comprised of shape memory alloy wire mesh, such as disclosed in U.S. Pat. No. 5,607,756 to Yamauchi et al. on Mar. 4, 1997. The ductile mesh 20 may alternately be a knit wire mesh 100 (FIG. 5) having warp and weft shape memory alloy wires, for example, which preferably consist of Ni/Ti alloy that exhibit superelasticity at room temperature. The ductile mesh 20 is able to conform to irregular surfaces and shapes without breaking, creasing, or tearing all while being able to maintain any shape into which it is formed.

Figure 2:
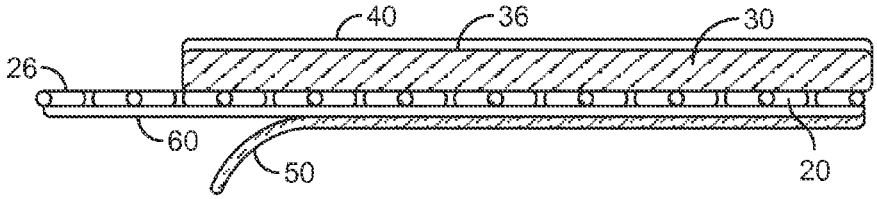
FIG. 2 is a cross-sectional view of the invention, taken generally along lines 2-2 of FIG. 1.

The elastomeric membrane 30 has a substantially flat top surface 36 that is adapted to receive the image 15 thereon (FIG. 2). The elastomeric membrane 30 may be a sponge rubber material, such as sold by Griswold Rubber Company of Moosup, Conn. 06354 under the trade name Kushon cellular sponge rubber. A re-odorant may be added to such a material to eliminate the smell of any white pigment applied thereto (not shown). Alternately, the elastomeric membrane 30 may be a silicone material, such as that produced by Rubber-Cal, Inc. of Santa Ana, Calif. 92707, referred to as a thick FDA grade white silicone. A latex material, such as Conklin Company, Inc.'s (Shakopee, Minn.) "Acrylic Latex Elastomeric Coating" may also be utilized as the elastomeric membrane 30. Alternately, an elastomeric textile fabric material such as spandex (L.A. Warehouse, Los Angles, Calif. 90021, Material: White Tactile Polyester/Lycra), an elastomeric gesso material (Conservator's Product Company, Flanders, N.J. 07836, Material: Beva Gesso), which is a type of composition for treating both natural and synthetic fabrics typically used in conjunction with printing on fabrics with the use of inkjet printers, thermal, piexo, picot, or laser printers, copiers, or the like. Alternately, the elastomeric membrane 30 may be a cross-linked polyurethane material such as "Thermal Resistant Material-Cross-linked PU, 1 mm" from Geltec Industry Ltd. out of Taichung, Taiwan) or the like. In the case where the elastomeric membrane 30 is spandex, the spandex is preferably elastomeric in two substantially orthogonal directions, such that the elastomeric membrane 30 does not bunch or crumple when being formed into irregular shapes.

Figure 3:
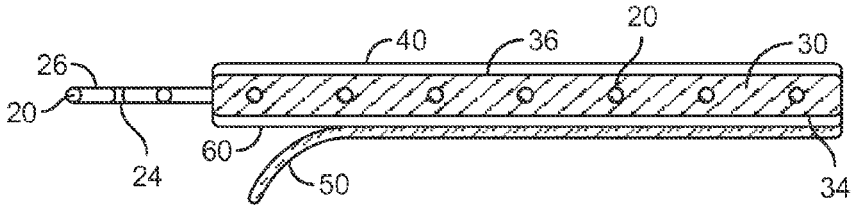
FIG. 3 is a cross-sectional view of an alternate embodiment of the invention, taken generally along lines 2-2 of FIG. 1.
Figure 4:
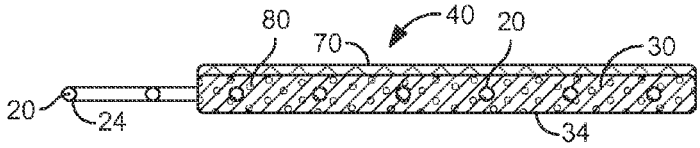
FIG. 4 is a cross-sectional view of another alternate embodiment of the invention, taken generally along lines 2-2 of FIG. 1.

In another embodiment of the invention, the elastomeric membrane 30 is fixed around the ductile mesh 20, working through and around the mesh 20, such that the mesh 20 is substantially embedded within the membrane (FIGS. 3 and 4). Such an embodiment of the media 10 may be formed by pouring uncured elastomeric membrane material 30 around the ductile mesh 20, for example. When the elastomeric membrane material 30 is cured, the image 15 may then be applied to the media 10.

Figure 5:
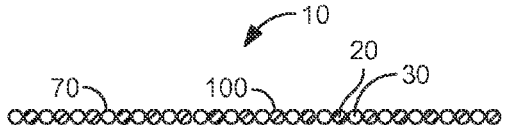
FIG. 5 is a cross-sectional view of yet another alternate embodiment of the invention, taken generally along lines 2-2 of FIG. 1.

Alternately, as illustrated in FIG. 5, the elastomeric membrane 30 is comprised of elastomeric fibers 70 knit together with ductile fibers 100. As such, the elastomeric membrane 30 and the ductile fibers 100 are combined in a woven material by using a device such as a raschel warp knitting machine, for instance, to create a hybrid knit wire mesh as the ductile mesh 20.

In the preferred embodiment of the invention, illustrated in FIGS. 2 and 3, a printable coating 40 is applied to the top surface 36 of the membrane 30. The printable coating 40 may be an elastomeric gesso material, an ink-jet ink receptive coating (such as produced under the trade name Magic® Inkjet solutions by InteliCoat of South Hadley, Mass. 01075), a dye-sublimation ink-receptive coating or fabric (such as the White Tactile Polyester/Lycra material produced by L.A. Warehouse, Los Angeles, Calif. 90021), an elastomeric rubber material, or the like. Such a coating 40 is fused to or otherwise fixed to at least one side of the elastomeric membrane 30 or the ductile mesh 20. The preferred embodiment of the media 10 is a dye-sublimation ink-receiving layer 40 vulcanized directly onto an open-cell sponge rubber layer 30 through the substantially open areas of the ductile mesh 20. The total thickness of such a media 10 is preferably 1/16 of an inch or less.

An alternate preferred embodiment of the media 10 comprises the fabric layer 40 bonded directly to the ductile mesh 20 with an elastomeric, hot-melt, pressure-sensitive adhesive 60 (such as H2503 or H2504 from Bostik-Findley, Inc., of Wauwatosa, Wis.). Such an embodiment may be made relatively thin so as to be suitable for use with a relatively large number of printing devices.

In one embodiment of the invention, a selectively removable liner 50 is temporarily fixed with adhesive 60 to a bottom surface 24 of the mesh 20 or to a bottom surface 34 of the elastomeric membrane 30 (FIGS. 2 and 3, respectively). Such a removable liner 50 may be made from paper, acetate or other film, Tyvex®, or any other suitable web material that is inelastic and can be temporarily adhered to the media 10. Such an inelastic liner 50 prevents printer feeding rollers (not shown) or the like from deforming or stretching the media 10 as the media 10 advances through the printing process.

In use, an image 15 may be printed onto the ductile media 10 by a) providing the media 10 and b) instructing a user to print the image 15 onto the ductile media 10 with a printing device, such as an inkjet printer, silkscreen apparatus, or the like (not shown). The media 10 is thin enough to pass through such a printing device. In the embodiment that includes the liner 50, the liner 50 prevents the elastomeric membrane 30 from significant stretching in any dimension as the media 10 is passed through the printing device (not shown).

Figure 6:
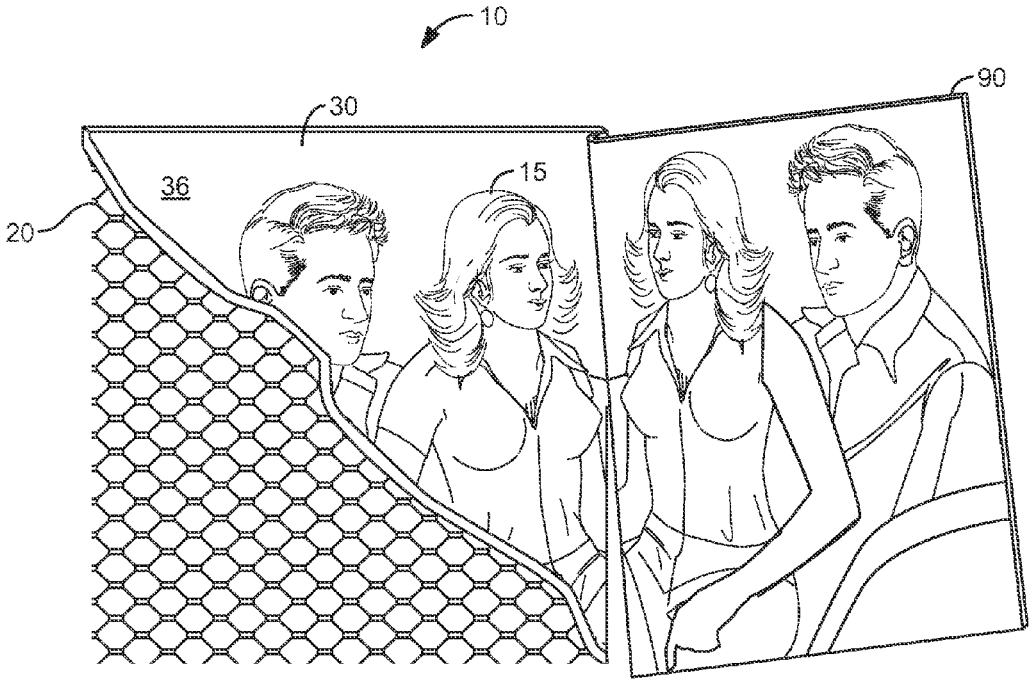
FIG. 6 is a partially cut-away perspective view of the invention, illustrating an image applied thereto with a heat transfer sheet.
Figure 7:
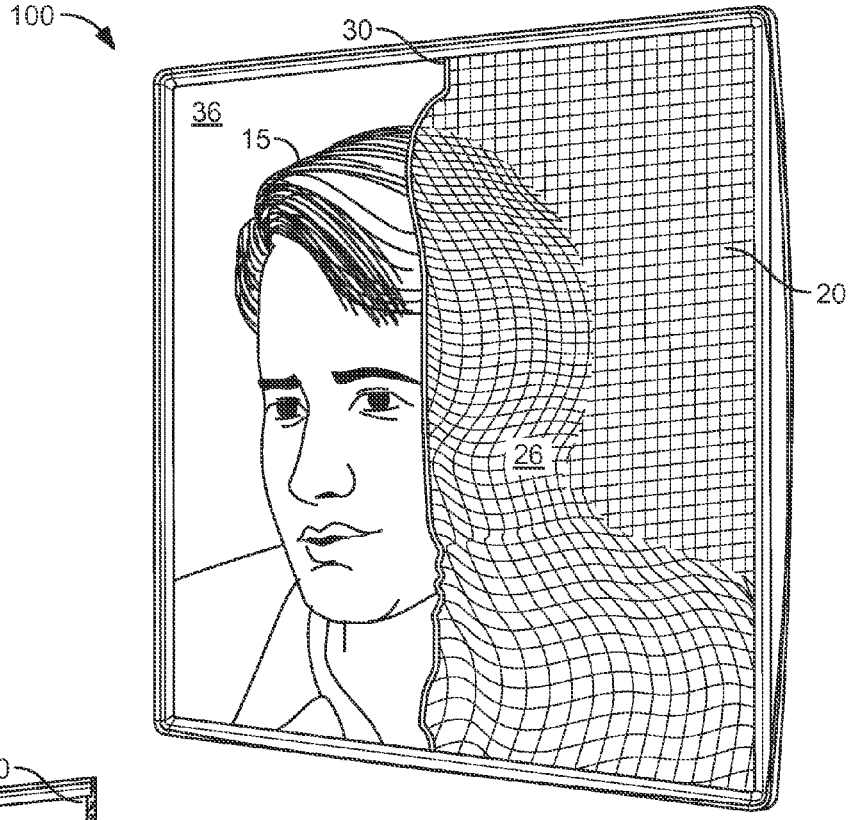
FIG. 7 is a partially cut-away perspective view of the invention, illustrating the media thereof formed into a three-dimensional shape.

Alternately the image 15 may be applied to the ductile media 10 by instructing a user to print the mirror image of the image 15 onto a transfer sheet 90 (FIG. 6), which is then applied to the top surface 36 of the elastomeric membrane 30, or to the printable coating 40 if present, and heated to affect a heat transfer of the image 15 onto the media 10. On the other hand, the image 15 may be applied to the ductile media 10 by a screen printing process, the top surface 36 of the elastomeric membrane 30 adapted to receive screen printing ink (not shown).

Once the image 15 is printed on the media 10, the user may form the media 10 into a desired shape by applying pressure to the media 10. Various tools (not shown) may be used to aid in forming relief detail into the media 10, or a computer-aided pressure-applying device (not shown) may be used, such as a CNC or solenoid-driven impact device. Multiple such media 10 may be fixed together with adhesive or other mechanical fastening means to form a three-dimensional model (not shown).

Figure 8:
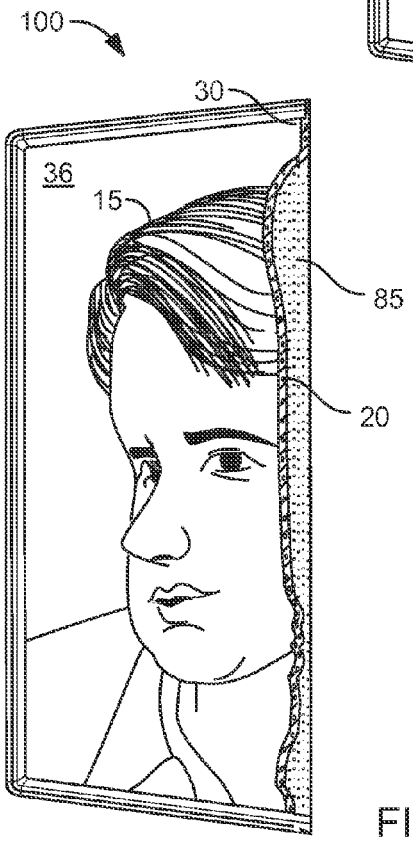
FIG. 8 is a partially cut-away perspective view of the invention, illustrating a bottom surface of the elastomeric membrane, formed into a substantially concave shape and filled with a hardening agent.

Additionally, the elastomeric membrane 30 may be impregnated or coated with a water-curable agent, ultraviolet ray (UV) curable agent, or heat-activated hardening agent, such that once the media 10 is formed into a desired shape, water, UV light, or heat may be introduced to the elastomeric membrane 30 to activate the hardening agent 80 and cause the media 10 to become substantially rigid. Examples of such water-curable hardening agents are gypsum, synthetic polyurethane prepolymer and the like. Alternately, the bottom surface 34 of the elastomeric membrane 30, once formed into a substantially concave shape, may be substantially filled with a hardening agent 85 (FIG. 8), such as a liquid foam, polymer, polyurethane resin, gypsum cement, adhesive materials, or the like. One method of accomplishing this is to place the media 10 around a frame such that the space between the inside of the frame and the bottom surface 34 of the media 10 may be filled with the hardening agent 85 until hardened (FIG. 8). As such, the hardening agent 85 bonds with the bottom surface 34 of the media 10, rendering the media 10 resistant to being reshaped. Alternatively, another method to protect the shaped ductile media from becoming damaged by chemicals, fading, or the like, is to apply a liquid-based laminate solution (such as Millennium XE™/Giclee Elixir from Optima International, www.optima-int.com, not shown). Such a liquid-based laminate can be applied to ductile media by brushing, rolling, mopping, spraying, or using liquid laminator machines.

While a particular form of the invention has been illustrated and described, it will be apparent that various modifications can be made without departing from the spirit and scope of the invention. For example, various materials may be used for the elastomeric material 30, provided each can be formed and stretched into various shapes as determined by the ductile mesh 20. Further, various materials may be used for the mesh 20 provided they are suitably ductile and hold their shape appropriately. Still further, various printable coatings may be applied to the elastomeric material 30 if desired. Accordingly, it is not intended that the invention be limited, except as by the appended claims.

What is claimed is:

1. A media for receiving an image thereon, the media comprising:

a ductile mesh; and an elastomeric membrane fixed to at least a top side of the mesh, the elastomeric membrane having a substantially flat top surface adapted to receive the image thereon, wherein the elastomeric membrane can be formed and stretched into various shapes without tearing, creasing, or bunching, and wherein the elastomeric membrane is fixed around the mesh, such that the mesh is substantially embedded within the membrane; and the ductile media can be shaped and formed manually or by using conventional embossing tools into a three-dimensional image.

2. The media of claim 1 wherein the elastomeric membrane is a silicone material.

3. The media of claim 1 wherein the elastomeric membrane is a cross-linked polyurethane material.

4. The media of claim 1 further including a selectively removable liner adhesively applied to at least one surface of the elastomeric membrane.

5. A media for receiving an image thereon, the media comprising:

a ductile mesh; and an elastomeric membrane fixed to at least a top side of the mesh, the elastomeric membrane having a substantially flat top surface adapted to receive the image thereon, wherein the elastomeric membrane is sponge rubber material that can be formed and stretched into various shapes without tearing, creasing, or bunching; and the ductile media can be shaped and formed manually or by using conventional embossing tools into a three-dimensional image.

6. A media for receiving an image thereon, the media comprising:

a ductile mesh; and an elastomeric membrane fixed to at least a top side of the mesh, the elastomeric membrane having a substantially flat top surface adapted to receive the image thereon, wherein the elastomeric membrane is a textile fabric material that can be formed and stretched into various shapes without tearing, creasing, or bunching; and the ductile media can be shaped and formed manually or by using conventional embossing tools into a three-dimensional image.

7. The media of claim 6 further including a printable coating applied to the top surface of the membrane, the printable coating adapted to receive the image thereon.

8. The media of claim 7 wherein the printable coating is an elastomeric ink-receptive coating.

9. The media of claim 7 wherein the printable coating is an elastomeric dye-sublimation ink-receptive coating.

10. The media of claim 6 wherein the ductile mesh is an expanded metal material.

11. The media of claim 6 wherein the ductile mesh comprises warp and weft, at least one of the warp and one of the weft comprising shape memory alloy wires.

12. The media of claim 11 wherein the shape memory alloy wires consist of a Ti—Ni series alloy exhibiting superelasticity at room temperature.

13. The media of claim 11 wherein the ductile mesh is knit wire mesh.

14. The media of claim 13 wherein the elastomeric membrane is comprised of elastomeric fibers knit together with ductile wires to form a hybrid knit wire mesh.

15. The media of claim 6 wherein a water-curable hardening agent is applied to the elastomeric membrane.

16. The media of claim 6 wherein an ultraviolet light-curable hardening agent is applied to the elastomeric membrane.

17. The media of claim 6 further including a selectively removable liner adhesively applied to at least one surface of the mesh.

18. The media of claim 6 wherein the textile fabric material is elastomeric in two substantially orthogonal directions.

19. A media for receiving an image thereon, the media comprising:

a ductile mesh; and an elastomeric membrane fixed to at least a top side of the mesh, the elastomeric membrane having a substantially flat top surface adapted to receive the image thereon, wherein the elastomeric membrane is fixed around the mesh, such that the mesh is substantially embedded within the membrane.

20. The media of claim 19, further comprising a printable coating applied to the top surface of the membrane, the printable coating adapted to receive the image thereon.

21. The media of claim 19, further comprising a selectively removable liner adhesively applied to at least one surface of the ductile media.

* * * * *